US005517837A

United States Patent [19]

Wang

[11] Patent Number: 5,517,837

[45] Date of Patent: May 21, 1996

[54] DISC BRAKE LOCKING ASSEMBLY

[76] Inventor: Teng-Cheng Wang, No. 34, Lane 160, Kang Shan Chung, Kaohsiung, Taiwan

[21] Appl. No.: 105,542

[22] Filed: Aug. 12, 1993

[51] Int. Cl.[6] ..... E05B 67/36

[52] U.S. Cl. ..... 70/226; 70/33; 70/233

[58] Field of Search ..... 70/226, 38 R, 70/38 A, 38 B, 32, 33, 233, 463, 225, 227, 228, 34; 292/182, 181, 177, 179

[56] References Cited

U.S. PATENT DOCUMENTS

| | | | |
|---|---|---|---|
| 610,551 | 1/1867 | Decker | 70/463 |
| 638,690 | 12/1899 | Ashcroft | 70/463 |
| 2,104,981 | 1/1938 | Falk | 70/38 R |
| 2,140,490 | 12/1938 | Wise | 70/38 R |
| 2,656,704 | 10/1953 | Mancuso | 70/33 |
| 2,904,985 | 9/1959 | Murphy | 70/38 B |
| 4,294,090 | 10/1981 | Metzger | 70/53 |
| 5,069,048 | 12/1991 | Lo | 70/226 |
| 5,133,201 | 7/1992 | LaMott et al. | 770/226 |
| 5,265,451 | 11/1993 | Phifer | 70/226 |
| 5,287,245 | 2/1994 | Lucente et al. | 292/181 |
| 5,365,758 | 11/1994 | Shieh | 70/226 |
| 5,379,618 | 1/1995 | Shieh | 70/227 |
| 5,442,941 | 8/1995 | Kahonen et al. | 70/455 |

FOREIGN PATENT DOCUMENTS

| | | | |
|---|---|---|---|
| 2810756 | 9/1978 | Germany | 70/33 |
| 413238 | 4/1946 | Italy | 70/33 |

*Primary Examiner*—Darnell M. Boucher
*Attorney, Agent, or Firm*—Pro-Techtor International

[57] ABSTRACT

The present invention concerns a disc brake locking assembly. Specifically, a lock is employed to control the up-down movement of a controlling cotter, and the disc brake locking assembly is placed in the locked position by causing the catch on the front of the controlling cotter to bind to the catch section of a locking rod. Said disc brake locking assembly possesses a moving piece. The top of said moving piece is equipped with a protruding pin, and the bottom of said moving piece is equipped with a slot A into which a spring is to be inserted. Said moving piece also possesses another slot B. A pin is installed into the main body in such a manner that allows one end of said pin to penetrate through said main body and join with the slot B in the moving piece. The restitution action of the spring allows said moving piece to move back and forth axially within a specified range. The left side of said moving piece is also equipped with a round slot into which a spring and locking rod are inserted in said order. The configuration allows the locking rod to move back and forth. Accordingly, said disc brake locking assembly equipped with said locking rod is capable of sensing the presence of a ventilation opening, when the opening slot is inserted into the braking disc and the locking rod comes into contact with said braking disc, thereby eliminating the need of finding a ventilation opening on the disc brake and aligning it manually and facilitating the locking operation.

1 Claim, 3 Drawing Sheets

DISC BRAKE LOCKING ASSEMBLY

DESCRIPTION OF THE INVENTION

The present invention concerns a disc brake locking assembly. More particularly, said disc brake locking assembly involves the employment of a locking pin that is capable of sensing the presence of a ventilation opening, thereby eliminating the need of finding a ventilation opening on the disc brake and aligning it manually with the locking pin of a disc brake lock.

In light of the fact that conventional configurations of disc brake locks are subject to drawbacks, such as being inconvenient to deploy and requiring complicated steps during the manufacturing process, the inventor arrives at the present invention, which concerns a disc brake locking assembly. Accordingly, the following merits are realized with the design improvement pertaining to the present invention:

1. The moving piece pertaining to the present invention moves accurately and reliably, because the cross section thereof is comparatively large.
2. The locking rod pertaining to the present invention cannot be damaged readily, because the controlling cotter is controlled indirectly by the lock cylinder and the locking rod, in turn, is also indirectly controlled by the controlling cotter; furthermore, said locking rod is actuated indirectly by the moving piece.
3. The bottom of the opening slot is equipped with a rubber cushion, so that the bottom of the opening slot cannot be damaged accidently by the braking disc during the deployment of the disc brake locking assembly.
4. The locking operation pertaining to the present invention can be performed rapidly, because said disc brake locking assembly involves the employment of a locking rod that is capable of sensing the presence of a ventilation opening when the opening slot is inserted into the braking disc and the locking rod comes into contact with said braking disc, thereby eliminating the need of finding a ventilation opening on the disc brake and aligning it manually with the locking pin of a disc brake lock.
5. The left side of the lock body pertaining to the present invention is equipped with a lock hole, which is a through hole, thereby allowing said lock hole to be clean and dirt to come out.

DETAILED DESCRIPTION OF THE PREFERRED EMBODIMENT

Figure 1:
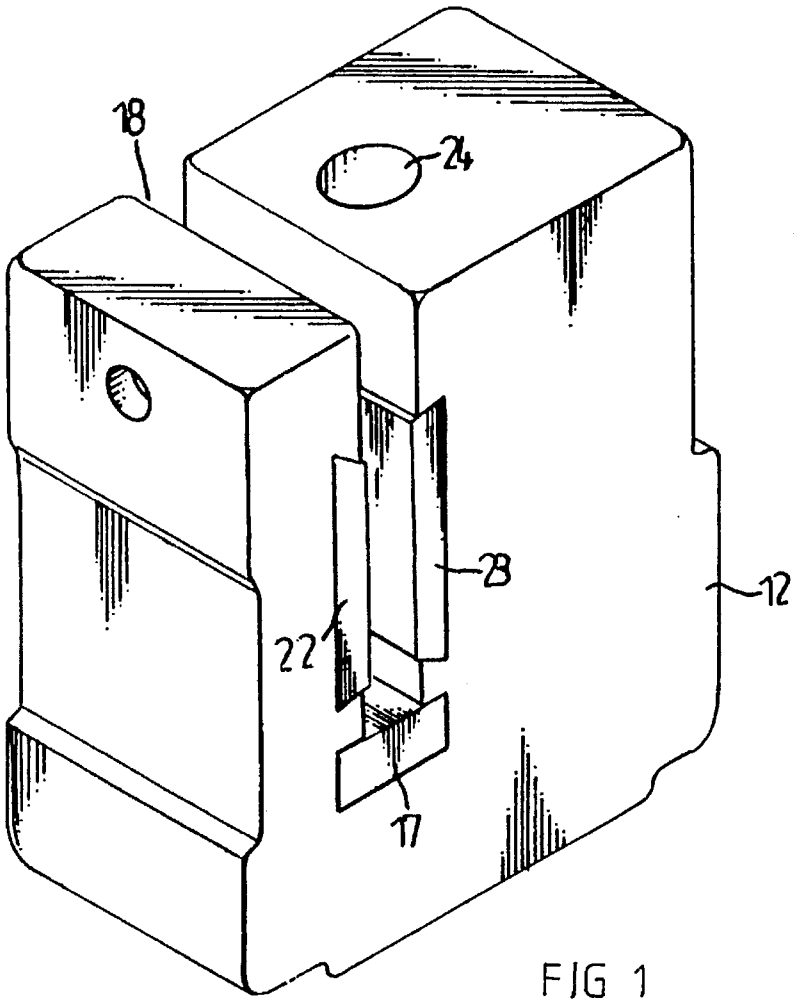
FIG. 1: A three-dimensional drawing of the disc brake locking assembly pertaining to the present invention.
Figure 2:
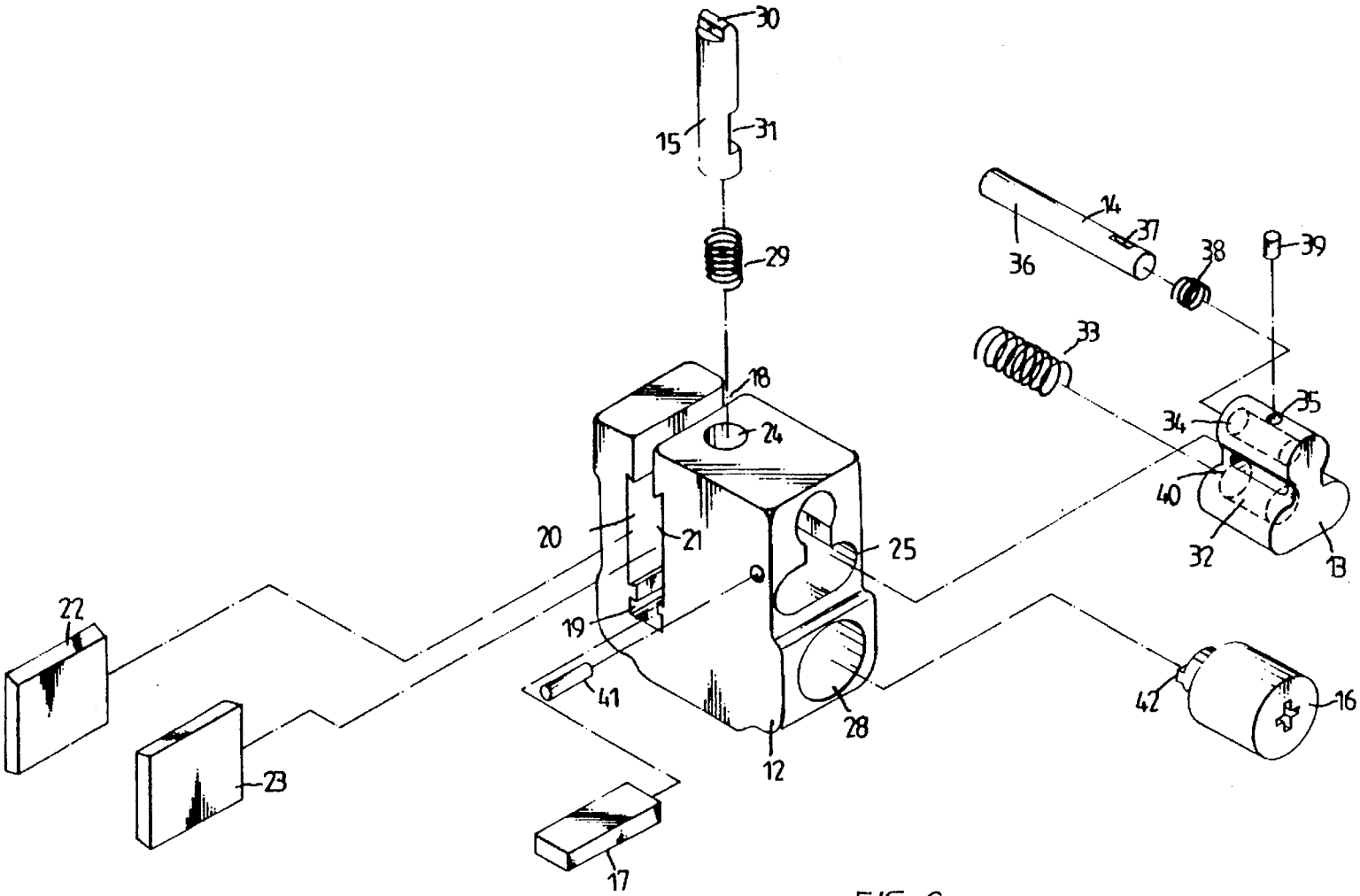
FIG. 2: A three-dimensional drawing showing the components of the disc brake locking assembly pertaining to the present invention.

As shown in FIGS. 1 and 2, the disc brake locking assembly pertaining to the present invention consists of components, which include a lock body 12, moving piece

Figure 4:
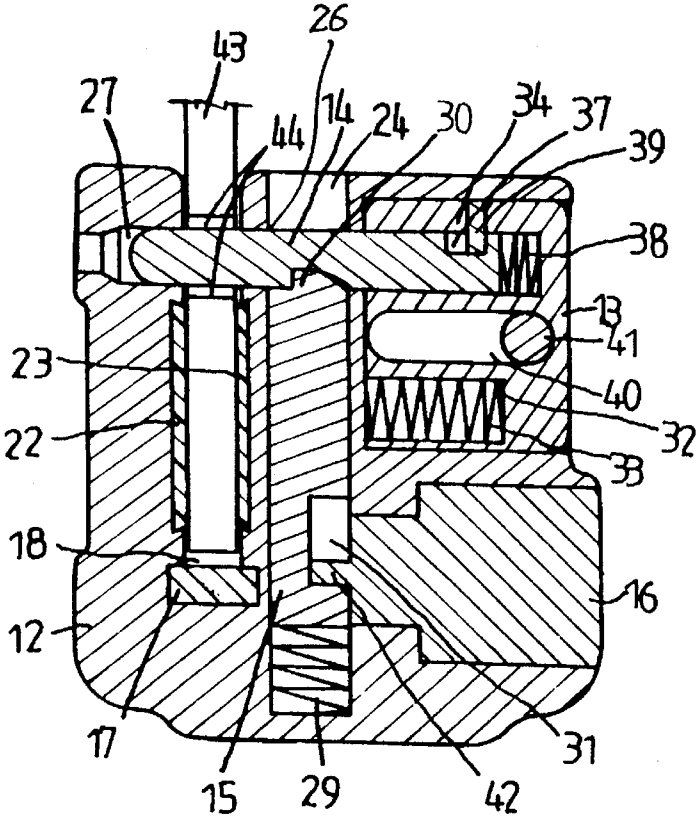
FIG. 4: A cross-sectional drawing showing the operation of the disc brake locking assembly pertaining to the present invention.
Figure 3:
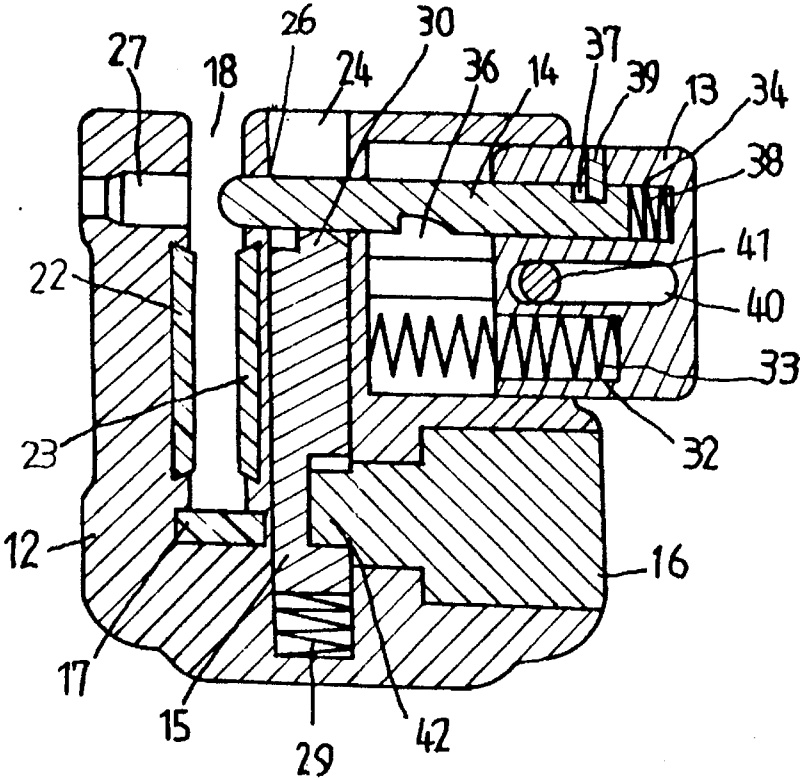
FIG. 3: A cross-sectional drawing of the disc brake locking assembly pertaining to the present invention.

13, locking rod 14, controlling cotter 15 and rubber cushion 17. An opening slot or slot-like opening 18 with an opening facing upward is located at an appropriate location on the left side of said lock body 12. Accordingly, said lock body 12 exhibits a U-shaped configuration. The bottom of said opening slot 18 is equipped with a rectangular slot 19, and a rubber cushion 17 is placed inside said rectangular slot 19. As shown in FIG. 2, the left and right sides of said opening slot 18 possess trapezoidal slots 20 and 21 respectively at corresponding positions. As shown in FIG. 3, the trapezoidal slots 20 and 21 are equipped with rubber pieces 22 and 23 respectively, so that damage caused by the braking disc striking on said disc brake locking assembly can be prevented. Said disc brake locking assembly also possesses a vertical cotter hole 24 at a specific location on the right upper part of said lock body 12, and a FIG. 8 slot or receiving aperture 25 with a certain specified depth on the upper right side wall of said lock body 12, as shown in FIGS. 3 and 4. In addition, an axial through hole 24 is made at a specific location on the FIG. 8 slot 25 in such a manner that said through hole 26 is connected to said vertical hole 24 and penetrates into said opening slot 18. An interior lock hole 27 is made on the right side wall of the left side of said lock body 12 at a specific location corresponding to the through hole 26. Moreover, a lock cylinder hole 28 is made below the FIG. 8 slot 25, and the front of said lock cylinder hole 28 is connected to said vertical hole 24. A first spring 29 and a controlling cotter 15 equipped with a catch 30 on the top thereof and a lock tongue receiving slot 31 at the lower part thereof are placed into said vertical hole 24 in said order. The moving piece 13, which exhibits a FIG. 8 shape having an upper and lower portion, fits snugly into said FIG. 8 slot 25. The lower part of said moving piece 13 is elliptical and is equipped with a round slot 32 on the left side, while the upper part of said moving piece 13 is round and is equipped with a round slot or lateral hole 34. A third spring 33 is placed inside said round slot 32, while a vertical round slot or hole 35 is made at a specific location on the top of said moving piece 13 and connected to said round slot 34. The underside of one end of said locking rod 14 is equipped with a catch section 36 at a specified location, and the upper side of the other end is equipped with a slot 37. The end of said locking rod 14, possessing said catch section 36, is round, while the other end has a flat surface. A second spring 38 and said locking rod 14 are placed inside the round slot 34 on the upper left side of said moving piece 13 in said order, and a second pin 39 is then inserted into said slot 37 on the upper part of said locking rod 14 through said round slot 35, so that said locking rod 14 is bound to said moving piece 13. The waist area of said moving piece 13 is equipped with a slot 40. The assembled moving piece 13 containing said locking rod 14 is then inserted into said FIG. 8 slot 25. Said operation allows said locking rod 14 to be inserted snugly into the through hole 26 and the rounded end of said locking rod 14 to protrude slightly into said opening slot 18, so that said locking rod 14 can come into contact with the braking disc 43. Said lock body 12 is equipped with a pin 41, with one end thereof extending inside said lock body 12 and joining the slot 40 located on said moving piece 13. The configuration allows said pin 41 to control the extent said moving piece 13 can move back and forth and to govern the position thereof precisely. The front of said lock cylinder 16 possesses a rectangular tongue 42, and the installation of said lock cylinder 16 into said lock hole 28 causes the rectangular tongue 42 at the front of said lock cylinder 16 to be inserted into the vertical hole 24 and rest inside the slot 31 of said controlling cotter 15. Accordingly, the up-down movement of said controlling cotter is governed by the turning of said lock cylinder either for locking or unlocking.

The locking operation of said disc brake locking assembly is described below. As shown in FIGS. 3 and 4, when the opening slot 18 pertaining to said disc brake locking assembly is inserted into the braking disc 43 (see FIG. 3), said braking disc 43 comes into contact with the rounded end of said locking rod 14, causing said locking rod 14 to be pushed into the round slot 34 of the moving piece 13, opposing said spring 38. When the round face of said locking rod 14 comes into contact with a ventilation opening 44 on the braking disc 43, the restitution force of said spring 38 causes the round face of said locking rod 14 to be inserted into said ventilation opening on said braking disc 43. Next, the moving piece 13 in the lock body 12 is pushed forward, causing said locking rod 14 to be inserted into the lock hole 27 after penetrating through the ventilation opening 44 on the braking disc 43. Meanwhile, the restitution force of the spring 29 causes the controlling cotter 15 to move upward, thereby allowing the catch 30 on top of said controlling cotter 15 to bind tightly onto the catch section 36 on said locking rod 14, and completing the locking operation. Said disc brake locking assembly can be unlocked by turning the lock cylinder 16 to the opening position. Said action changes the orientation of the rectangular piece 42 at the front of said lock cylinder 16, as shown in FIG. 3. As a result, said controlling cotter 15 is caused to move downward, thereby releasing the catch 30 on top of said controlling cotter 15 from the catch section 36 and freeing said locking rod 14. The restitution force of the spring 33 causes the moving piece 13 to move away from the lock body 12, which allows said locking rod 14 to return to said through hole 26, with the round face situating in the opening slot 18.

I claim:

1. A disc brake locking assembly comprising:

a lock body, a moving piece, a locking rod having a locking rod slot and a catch section, a controlling cotter having a lock tongue receiving slot and a catch, and a lock cylinder having a tongue at its interior end; said lock body including a slot-like opening, said opening having side walls and including a rectangular slot in a lower end thereof; said slot and said side walls having cushioning means;

said lock body further including a receiving aperture to receive said moving piece, a cotter hole having a longitudinal axis substantially parallel to the sidewalls of the slot-like opening to receive said controlling cotter and a first biasing spring, a lock hole perpendicular to and intersecting with the cotter pin hole to receive said lock cylinder, an interior lock hole having an axis perpendicular to and intersecting with the slot-like opening to receive a rounded end of said locking rod when the locking rod is in a locked position, and a first pin that limits movement of said moving piece in said lock body, said first pin engaging a slot in the moving piece;

said moving piece being formed generally in the shape of a FIG. 8, an upper portion of said moving piece having a lateral hole to receive said locking rod and a second biasing spring, said upper portion of said moving piece further including a vertical hole to receive a second pin that limits movement of said locking rod in said moving piece, said second pin engaging said locking rod slot in the locking rod, a lower portion of said moving piece including a hole to receive a third biasing spring; said rounded end of said locking rod being biased by said second spring into said slot-like opening;

wherein said locking assembly is adapted to receive a braking disc in said slot-like opening in said lock body; whereby the braking disc contacts said rounded end of said locking rod, overcoming the biasing force of said second biasing spring and forcing said locking rod out of said slot-like opening until a position of said locking rod corresponds to a position of a ventilation hole in said braking disc resulting in said second biasing spring urging said rounded end of said locking rod into said ventilation hole; said locking rod being movable to the locking position by the moving piece being moved into the lock body against the force of said third biasing spring whereby the locking rod and the moving piece are locked in the locking position by engagement of the catch of the cotter pin with the catch section of the locking pin; and wherein the lock assembly may be disengaged from the brake disk by turning said lock cylinder such that said tongue on the lock cylinder drives said controlling cotter against the force of the first biasing spring to disengage said controlling cotter from said locking rod, which in turn allows the force of said third biasing bring to push said moving piece outward from the lock body, thereby retracting said locking rod from said braking disc to a position where only said rounded end of said locking rod contacts said braking disc, whereby the locking assembly may be removed from the locking brake upon overcoming the force of said second biasing spring.

* * * * *